US006588359B1

(12) United States Patent
Powers

(10) Patent No.: US 6,588,359 B1
(45) Date of Patent: Jul. 8, 2003

(54) APPARATUSES AND METHODS FOR AT-SEA CARGO HANDLING AND RESCUE

(76) Inventor: James M. Powers, 3 Santa Lucia Ave., Ormond Beach, FL (US) 32174

( * ) Notice: Subject to any disclaimer, the term of this patent is extended or adjusted under 35 U.S.C. 154(b) by 0 days.

(21) Appl. No.: 10/232,419

(22) Filed: Sep. 3, 2002

Related U.S. Application Data

(63) Continuation-in-part of application No. 09/912,287, filed on Jul. 24, 2001, now abandoned.
(60) Provisional application No. 60/220,833, filed on Jul. 26, 2000.

(51) Int. Cl.[7] ..... B63B 35/44
(52) U.S. Cl. ..... 114/264; 414/137.1; 114/382; 441/80
(58) Field of Search ..... 114/264; 414/137.1, 414/137.9, 138.5, 138.7; 441/80

(56) References Cited

U.S. PATENT DOCUMENTS 3,413,946 A * 12/1968 Von Schultz ..... 114/124
4,527,503 A * 7/1985 Connelly ..... 114/365

* cited by examiner

*Primary Examiner*—Ed Swinehart

(57) ABSTRACT

Apparatuses for handling cargo in a body of water incorporate a high floating slender pylon floating upright in the water. The pylon is maintained afloat by a submerged variable buoyancy chamber carried by the pylon between its ends. Ballast carried by the pylon below the buoyancy chamber creates a righting couple about the buoyancy chamber that maintains the upright orientation of the pylon in the water. In a method of handling cargo, the top of the upright pylon is drawn toward a surface vessel carrying cargo to be transferred using the pylon. Cargo placed on the upper end of the tilted pylon can be supported stably above the water surface when the pylon is allowed to return to an upright orientation. The cargo can then be transferred to another surface vessel by reversing the steps used to place the cargo on the pylon. Among other uses, the pylon can be deployed for rescue at sea.

13 Claims, 7 Drawing Sheets

APPARATUSES AND METHODS FOR AT-SEA CARGO HANDLING AND RESCUE

CROSS-REFERENCE TO RELATED APPLICATIONS

This is a continuation-in-part of U.S. application Ser. No. 09/912,287 filed on Jul. 24, 2001, now abandoned which application claims priority under 35 USC 119(e) of U.S. provisional application No. 60/220,833, filed on Jul. 26, 2000.

BACKGROUND OF THE INVENTION

1. Field of the Invention

This invention is directed to apparatuses and methods for carrying out cargo handling and rescues in a body of water..

More particularly, this invention is directed to semi-submersible pylons, functioning as "Sea Cranes" that can, for example, be deployed at sea from marine vessels or drilling or oil production platforms. These sea cranes are stable submerged buoyancy apparatuses that serve to transfer objects in open sea from one surface vessel to another or from one vessel into or from the sea and to control or maintain such objects while under the stable management of the sea cranes. The sea cranes can stably and safely transfer cargoes between surface vessels, control or maintain, and safely transfer to or from mother ships, submersible vehicles or free floating objects even in the roughest seas.

This invention is also directed to methods for handling cargo at sea, including the transfer of cargo between surface vessels and between a surface vessel and the sea. This invention is also directed to apparatuses and methods employing semi-submersible pylons for effecting rescue of persons at sea.

2. Brief Description of Background Art

Cargo transfer of any type at sea has always been plagued with difficulty in rough seas and high winds. Even smooth waters present collision hazards when bringing surface vessels alongside to transfer cargo at sea. Similarly, when a surface vessel approaches a floating object for pickup at sea, collisions between object and vessel threaten. But stormy conditions compound the hazards even with the best equipment and the most skilled personnel. Launch, recovery, control and maintenance of autonomous or unmanned underwater vehicles (AUV or UUV), remotely operated vehicles (ROV), and manned submersibles is a case in point, in which mother ships without access to the present invention have difficulties with stormy conditions. Smooth waters provide opportunity for easy rescue by boat or helicopter. But stormy conditions risk the best equipment and the most skilled and heroic personnel.

U.S. patent application Ser. No. 09/912,287, filed by the inventor named in this CIP application, discloses a submerged buoyancy rescue pylon. The inventor is not aware of prior art related to the present invention.

OBJECTS OF THE INVENTION AND SUMMARY

An object of the present invention is to enable safer transfers of cargoes or people between ships under way in open sea.

Another object of the present invention is to enable safer transfers of cargoes or people between ships and water in open sea.

Another object of the present invention is to enable significant increases of rough water dive time for manned or unmanned submersibles or divers.

Another object of the present invention is to enable control and powering of ROV devices independently of a mother ship.

Another object of the present invention is to enable safer sea rescues under sea and weather conditions that would otherwise be difficult or impossible.

The foregoing objects of the invention and others as well are realized by a floating apparatus for transferring objects in a body of water from one surface vessel to another, the apparatus comprising: a slender elongated pylon; a cargo support at a first end of the pylon; a variable buoyancy chamber on the pylon between the first end of the pylon and a second end of the pylon; ballast carried by the pylon at the second end thereof, the ballast being of sufficient mass and being spaced from the variable buoyancy chamber by a sufficient distance to create a righting moment about the buoyancy chamber and establish an upright orientation of the pylon in the body of water with the cargo support disposed above the surface of the water and the ballast disposed below the surface of the water; and means for varying the buoyancy of the buoyancy chamber so as to maintain a desired submersion depth of the buoyancy chamber in the body of water.

The objects of the invention are also realized by an apparatus for rescuing persons from a body of water, the apparatus comprising: an elongated pylon; a compartment at a first end of the pylon for accommodating persons rescued from the body of water; a variable buoyancy flotation device at a second end of the pylon; ballast carried by the pylon and movable from a first position between the ends of the pylon to a second position extended beyond the second end of the pylon; annd means for effecting movement of the ballast from the first position to the second position to thereby establish an upright orientation of the pylon in a body of water with the compartment disposed above the surface of the water and the ballast disposed below the surface of the water varying the buoyancy of the flotation device so as to maintain a desired submersion depth of the flotation device in the body of water.

The objects of the invention are also realized by a method for handling cargo in a body of water, the method comprising the steps of: placing cargo at a first end of a slender elongated pylon deployed into the water, the pylon having a variable buoyancy chamber located between the first end and a second end of the pylon; applying a righting moment to the pylon that orients the pylon upright in the water such that (1) the first end of the pylon is disposed above the surface of the water and (2) the buoyancy chamber and the second end of the pylon are disposed below the surface of the water; and varying the buoyancy of the buoyancy chamber so as to maintain a desired submersion depth of the buoyancy chamber in the water while maintaining the first end of the pylon disposed above the surface of the water.

The present invention incorporates a high upright floating pylon with a cargo compartment at the top and a long narrow portion of the pylon above water with a submerged variable buoyancy compartment located on the pylon a distance above a ballast at the lower end of the pylon. The un-submerged portion of the pylon is designed slender to minimally change buoyancy due to wave action and to be high enough for the top thereof to clear the tallest wave crest. The variable buoyancy compartment is designed to be below water at all times and high enough above the ballast that a pylon righting moment is created by a couple between the center of buoyancy of that chamber and the center of gravity of the ballast. This righting moment is made great enough to create a stable cargo compartment high above the highest waves. The buoyancy of the submerged buoyancy compartment is varied by enlarging and reducing the volume of the compartment or by taking in and discharging water ballast, to maintain the upright pylon at its design waterline. The volume variation or purging of water ballast of the submerged buoyancy compartment is effected by an air compressor or release of compressed gas that maintains the pylon waterline at sea level just above the compartment.

The added sea crane embodiments of the sea crane are distinguishable from the rescue pylon described in the aforementioned application Ser. No. 09/912,287 in several ways. The erect rescue pylon supports cargo at the top of the pylon in a stable mode. But, if a surface vessel affixes a tag line to the top of the pylon and, while fending off the pylon at the waterline, the vessel takes in the tag line, tilting the pylon against the righting moment between submerged buoyancy and deeper pylon ballast, the cargo and the top of the pylon begin to move synchronously with the surface vessel. As the cargo and tilting pylon top approach the surface vessel, the amplitude of cargo motion matches that of the vessel avoiding a collision hazard between cargo and deck or vessel side during transfer. The transfer of cargo from surface vessel to pylon top reverses the above process. The sea crane concept can be applied to safely transfer cargoes between surface vessels or control and maintain and eventually safely transfer objects to or from mother ships, fixed structures, submersible vehicles or free floating objects while in the roughest seas.

Objects and advantages of several embodiments of the present invention are disclosed herein. Still further objects and advantages will become apparent from a consideration of the ensuing description and accompanying drawings.

DETAILED DESCRIPTION OF PREFERRED EMBODIMENTS

Figures 1A, 1B, 1C, 1D:
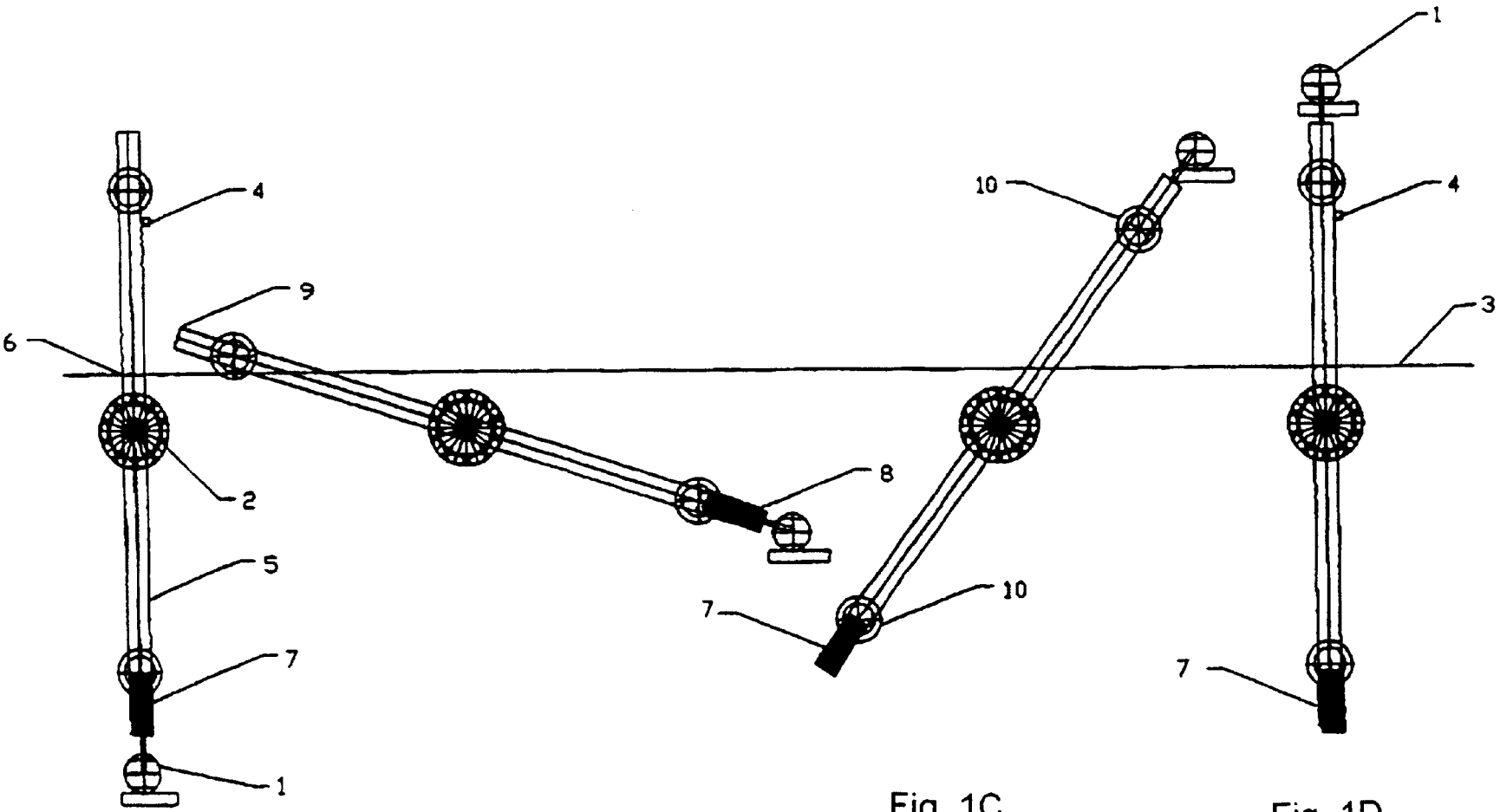
FIG. 1A is a schematic illustration of a sea crane incorporating teachings of the present invention with the pylon in an upright orientation and cargo loaded onto a platform at the bottom of the pylon.
FIG. 1B is a schematic illustration of the sea crane illustrated in FIG. 1A showing the pylon turned to a position in which the cargo is just beneath the surface of the water.
FIG. 1C is a schematic illustration of the sea crane illustrated in FIG. 1A showing the pylon turned to a tilted position in which the cargo is above the surface of the water.
FIG. 1D is a schematic illustration of the sea crane illustrated in FIG. 1A showing the pylon turned to an upright position in which the cargo is stably supported above the surface of the water.
Figure 2:
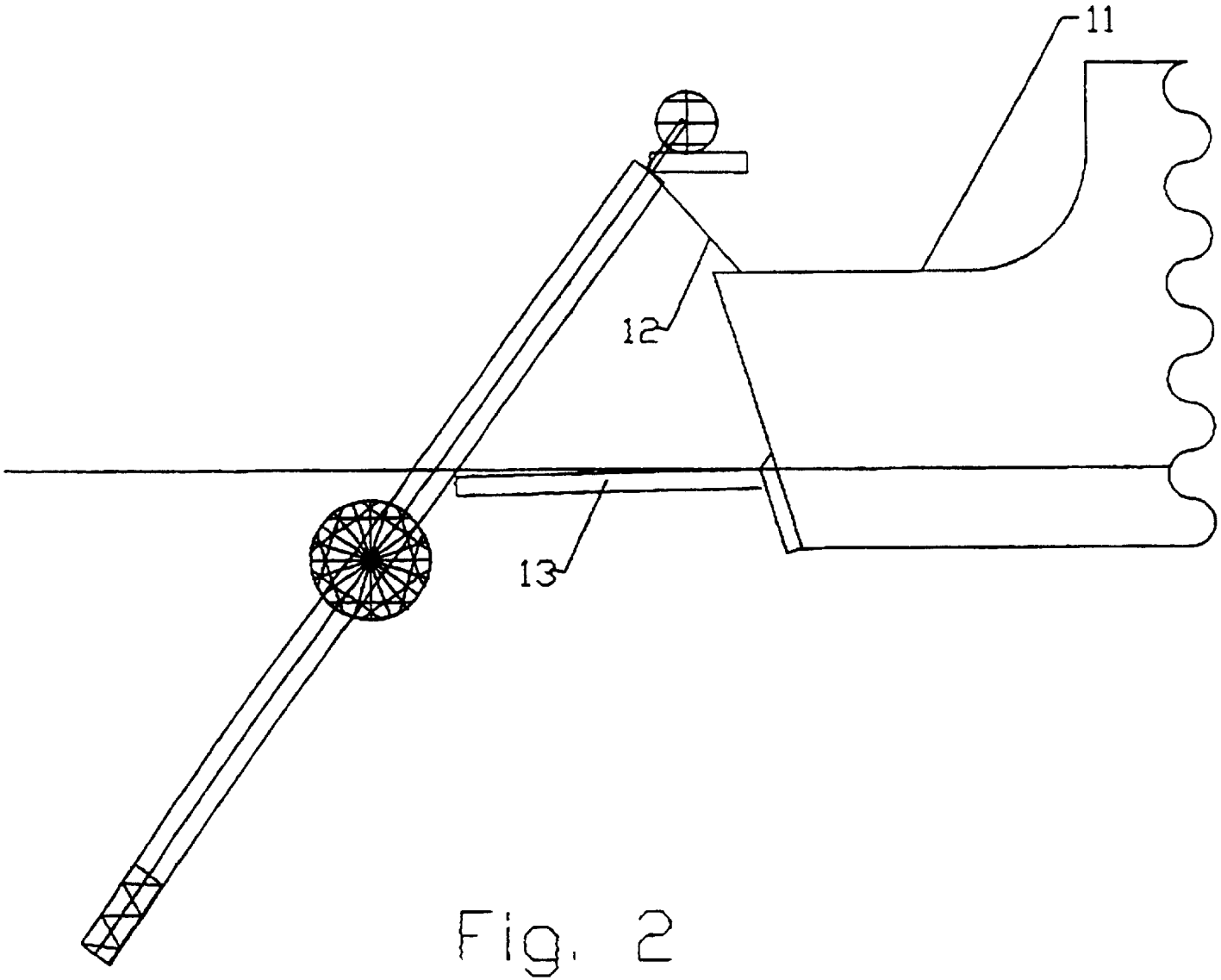
FIG. 2 is a schematic illustration of a sea crane being drawn to a position tilted toward the aft deck of a surface vessel.

The sea crane illustrated in FIGS. 1A–D and FIG. 2 is particularly adapted for recovering and/or launching cargo such as manned submersibles or unmanned submersibles (AUV) 1 or divers well below the surface of the sea. As in other embodiments of the present invention, in use, central submerged variable buoyancy chamber 2 is maintained at a fixed distance slightly below sea level 3. An air compressor 4 with an air intake well above sea level adjusts, or varies, the buoyancy chamber 2 to stabilize the pylon 5 with the waterline just above the submerged buoyancy chamber. A water surface sensor 6 at the chosen waterline on the pylon turns off the air compressor when the pylon rises to that level. Inversion is accomplished by shifting a movable stabilizing ballast 7 from one end 8 of the pylon to the other end 9. In the embodiment illustrated in FIGS. 1A–D, the movable ballast slides along the pylon by gravity when the buoyancy of the lower one of the two inverter buoyancy chambers 10 increases by introducing air, which can be from the same source that varies the buoyancy of the central buoyancy chamber. Alternatively, the shifting of the ballast can effected using other means, such as hydraulic or pneumatic devices or jackscrews. As shown in FIGS. 1C and 1D, the inversion of the sea crane lifts the cargo high above the waves. Subsequently, the cargo can be safely transferredto the aft deck of mother ship 11, as illustrated in FIG. 2, by winching tag line 12 while fending pylon off at the waterline 13 to tilt the pylon. The variable buoyancy chambers are either rigid chambers with water ballast purged by air from a pressurized source, such as an air compressor, or expandable chambers enlarged or reduced by adding or releasing air.

Figure 3:
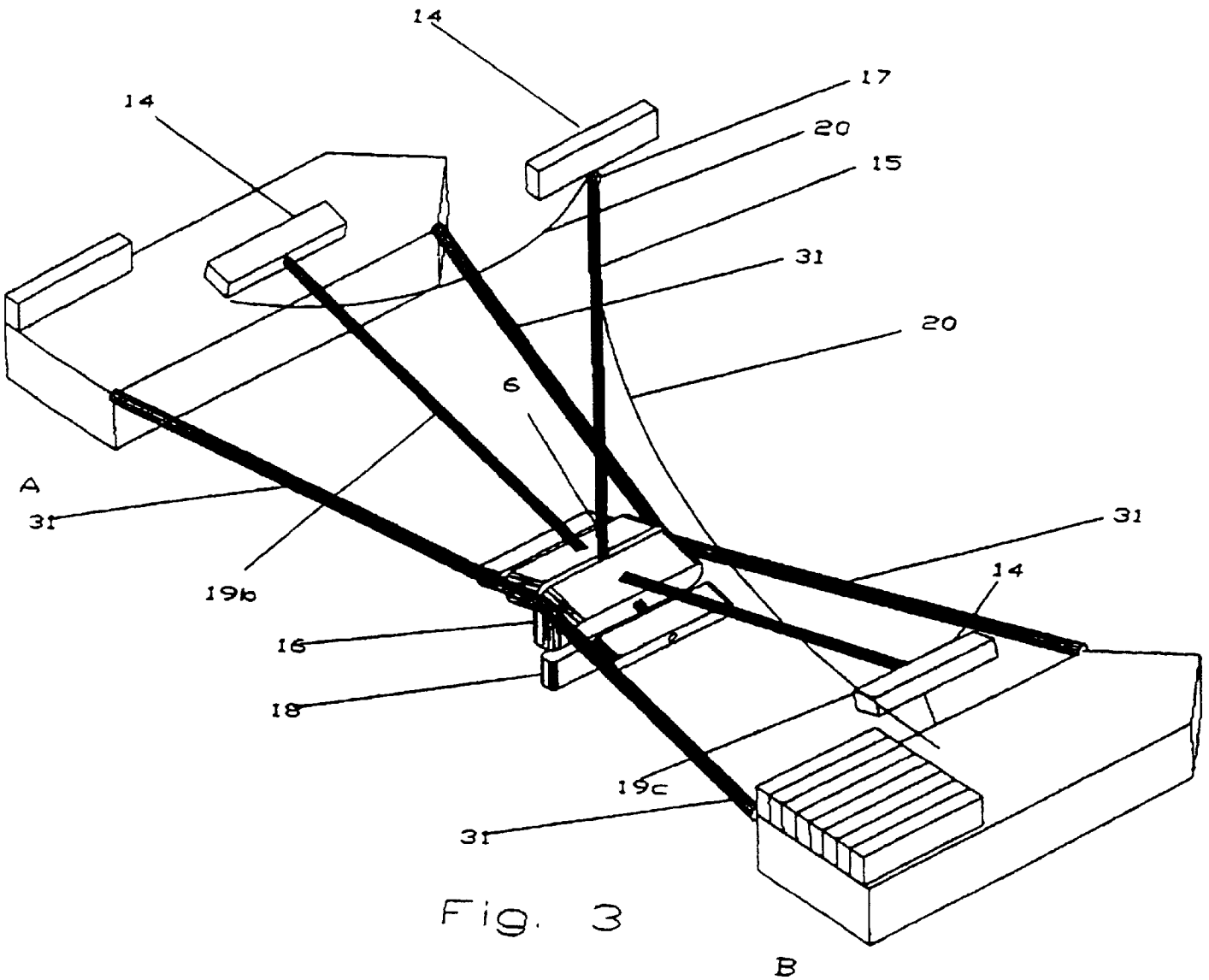
FIG. 3 is a schematic illustration of an embodiment of a sea crane with a paravane-shaped buoyancy chamber and ballast performing ship-to-ship cargo transfer.

FIG. 3 illustrates an apparatus configured to support a cargo 14 higher than cresting waves and presenting only a slender elongated structure to wave action. The slender structure, upper pylon 15 offers very little buoyancy and consequently little rise and fall due to wave action. Air or another gas gas under pressure is introduced into the submerged buoyancy chamber 16 adding sufficient buoyancy to support the added mass of any cargo high above the waves. As shown, an air compressor 17 adjusts the variable submerged buoyancy to stabilize the pylon with the waterline just above the submerged buoyancy chamber. A water surface sensor 6 at the chosen waterline on the pylon turns off the air compressor when the pylon rises to that level. The buoyancy of the vessel is counteracted by a ballast chamber 18 mounted at the base of the pylon to create a righting moment for the pylon about the buoyancy chamber 16. The buoyancy chamber and the ballast are both configured as a paravane attached to the pylon to facilitate towing or positioning by lines or outriggers 31 between two vessels A and B. The top of the sea crane pylon 19 is shown in alternate positions 19*b*, 19*c* with the pylon winched down (although tag lines are shown slack at 20) to take on or unload cargo at deck of either of the vessels.

Figure 4A:
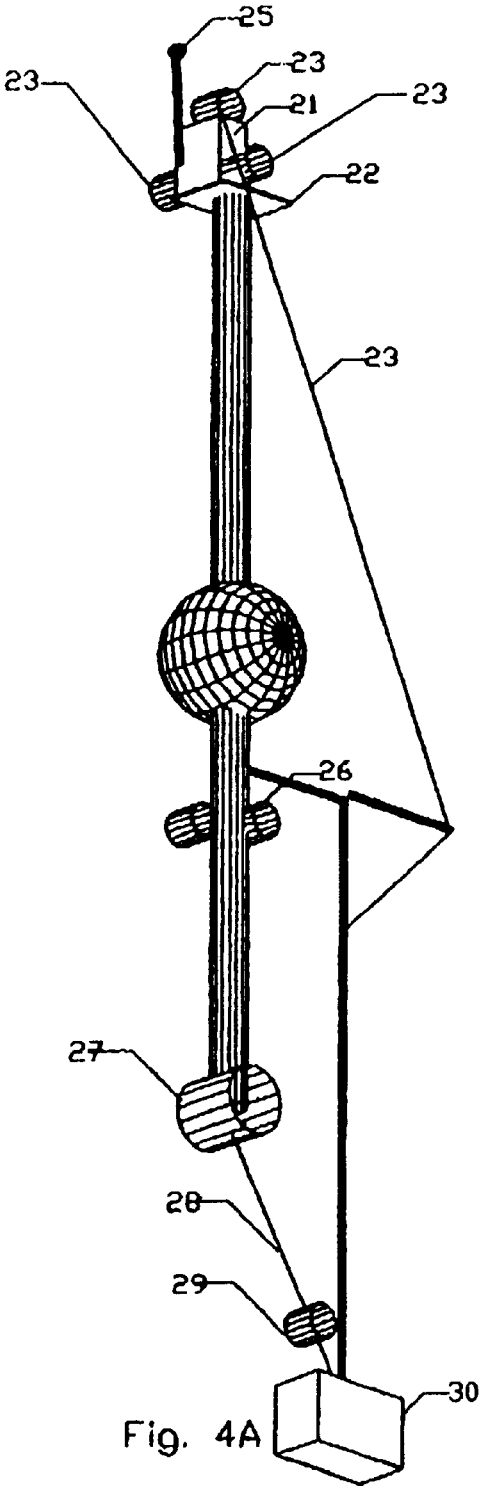
FIG. 4A is a schematic illustration of an embodiment of a sea crane configured for ROV Launch, recovery, control and maintenance.
Figure 4B:
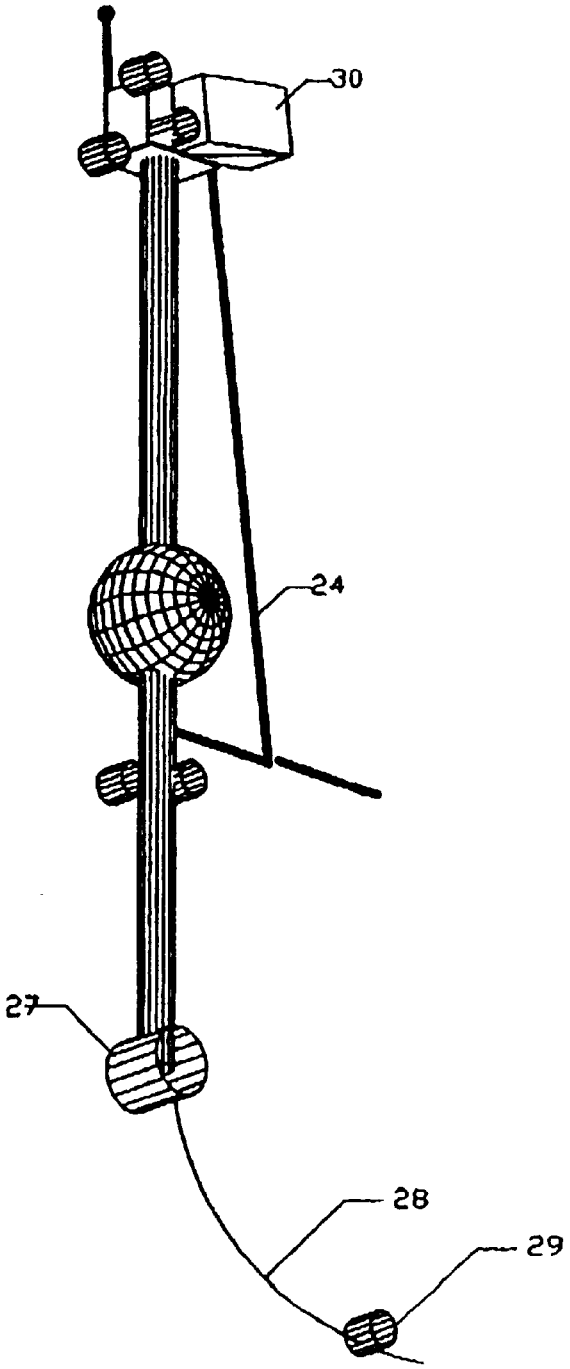
FIG. 4B is a schematic illustration of the sea crane illustrated in FIG. 4A showing the pylon turned to a position in which the cargo is just beneath the surface of the water.

Another embodiment of the present invention, illustrated in FIGS. 4A and 4B, is particularly adapted for ROV Launch, recovery, control and maintenance. As shown, a semi submersible pylon carries a diesel power plant 21 on a platform 22 at the top of the pylon. The power plant powers an air compressor, a generator and a winch and cable 23 for operating cargo transfer boom 24. The platform also mounts a microwave antenna 25 and associated electronics to transfer data to and from a mother vessel. The pylon carries thrusters 26 to maintain position and either a winch 27 to contain the ROV umbilical 28, or other means, such as a fairlead and anchor point to carry the upper end of the umbilical. The bottom end of the umbilical is fitted with a buoyant thruster 29 for controlling the end of the umbilical independently of the ROV, as if the ROV were docked at the end. The ROV 30 is capable of independently swimming down as an AUV or crawling down the umbilical cable to dock at the bottom end of the umbilical, then to operate conventionally. Any location on the umbilical or any submerged part of the sea crane can be fitted with a recharging and data transfer station for AUVs.

Figure 5:
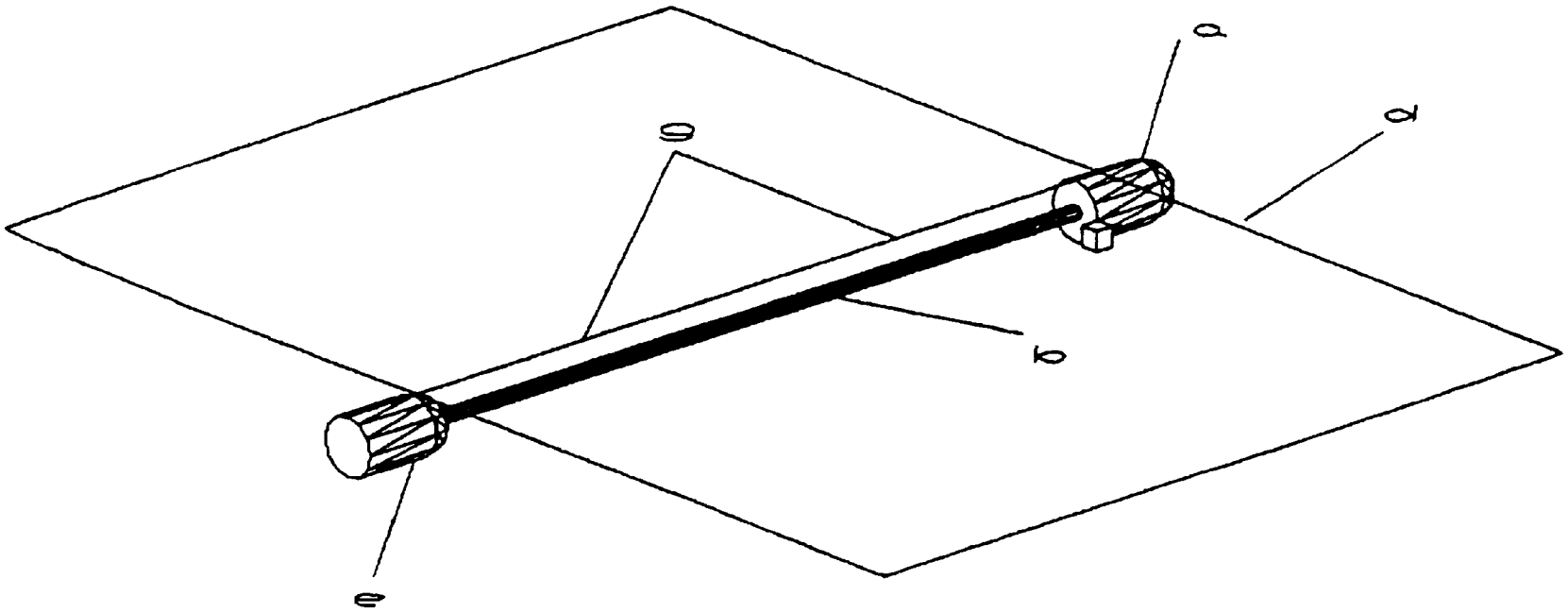
FIG. 5 is a schematic illustration of a rescue pylon floating horizontally as launched by plane or boat.
Figure 6:
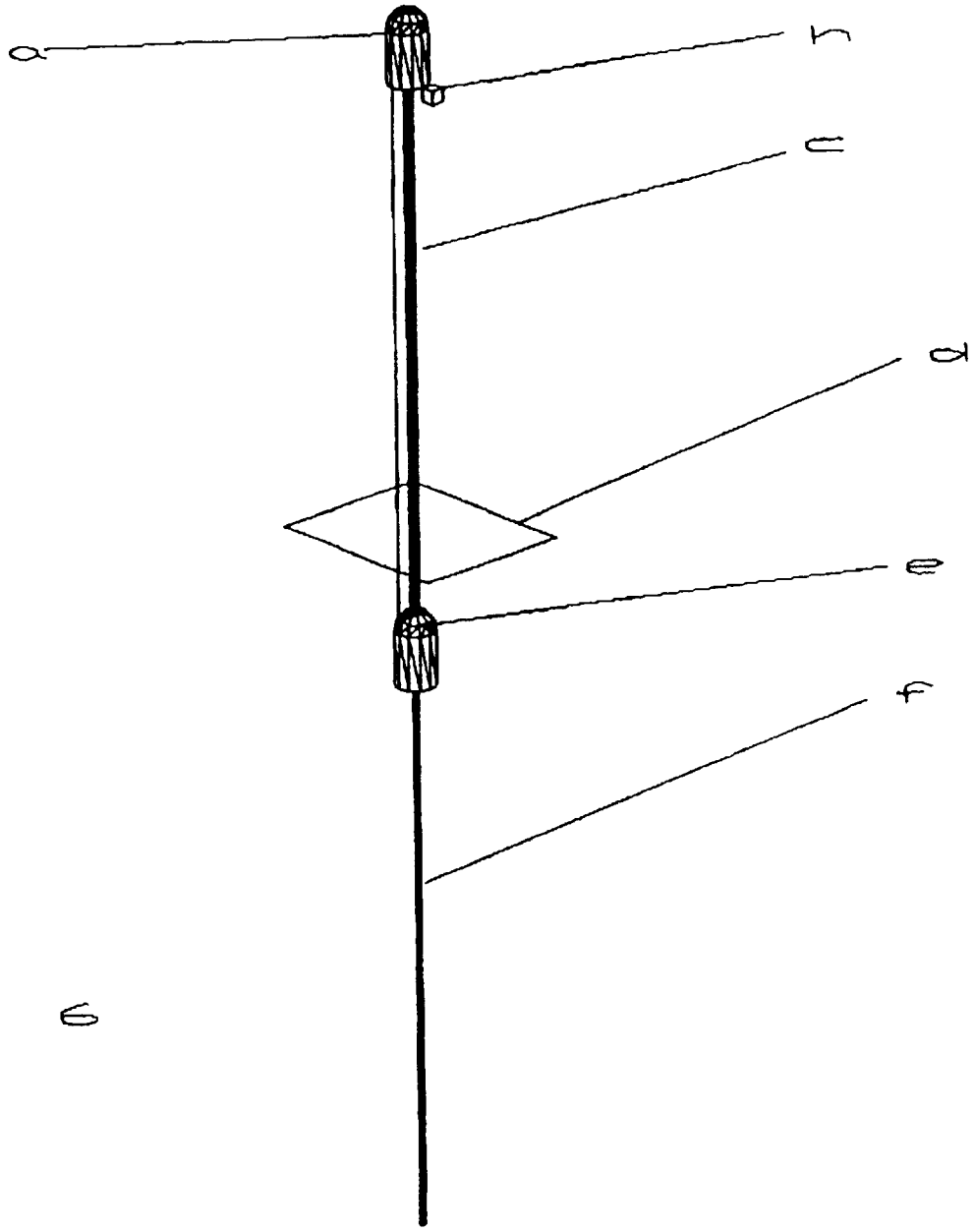
FIG. 6 is a schematic illustration of the rescue pylon illustrated in FIG. 5 showing the pylon in an erected upright position with the ballast shaft extended to act as an erecting and stabilizing keel.

FIGS. 5 and 6 illustrate a rescue apparatus designed to support a passenger compartment a higher than cresting waves, while presenting only a slender structure to wave action. The slender structure, pylon c, offers very little buoyancy and consequently little rise and fall due to wave action. The pylon must have, at a minimum, structural strength to act as a beam between submerged buoyancy compartment e and passenger compartment a when moving to an upright orientation lifting the passengers in the passenger compartment to a stable position safely above waves, relatively unaffected by breaking seas.

The pylon can be deployed from a rescue vessel or a helicopter. After deployment, the pylon floats generally horizontally, as shown in FIG. 5, buoyed at one end by the buoyant passenger compartment and at the other end by the variable buoyancy compartment. The horizontal flotation b provided by the passenger compartment and the submerged buoyancy compartment must be sufficient to keep the floating rope g strung between the compartments awash so rescuees can use it to pull themselves to the passenger compartment.

The passenger compartment can take the form of a life raft, a "crow's nest" or any buoyant self-draining enclosure strong enough to erect containing the designed passenger load. The rescuees climb into the passenger compartment then initiate an erection sequence that first pressurizes the pylon containing the nested ballast shaft b with gas, or actuates a spring, that effects telescoping movement of the ballast shaft down and away from the passenger compartment, deploying it as a keel f that erects and stabilizes the pylon and passengers, as shown in FIG. 6. Next, gas under pressure is introduced into the submerged buoyancy compartment adding approximate buoyancy to support the weight of all passengers high above the waves. An air compressor h, which may be battery-powered, then adjusts the buoyancy of the submerged variable buoyancy compartment to stabilize the pylon with a low waterline d maintained just above the submerged buoyancy compartment. An air sensor at the chosen waterline on the pylon turns off the air compressor when the pylon rises to that level.

Figure 7:
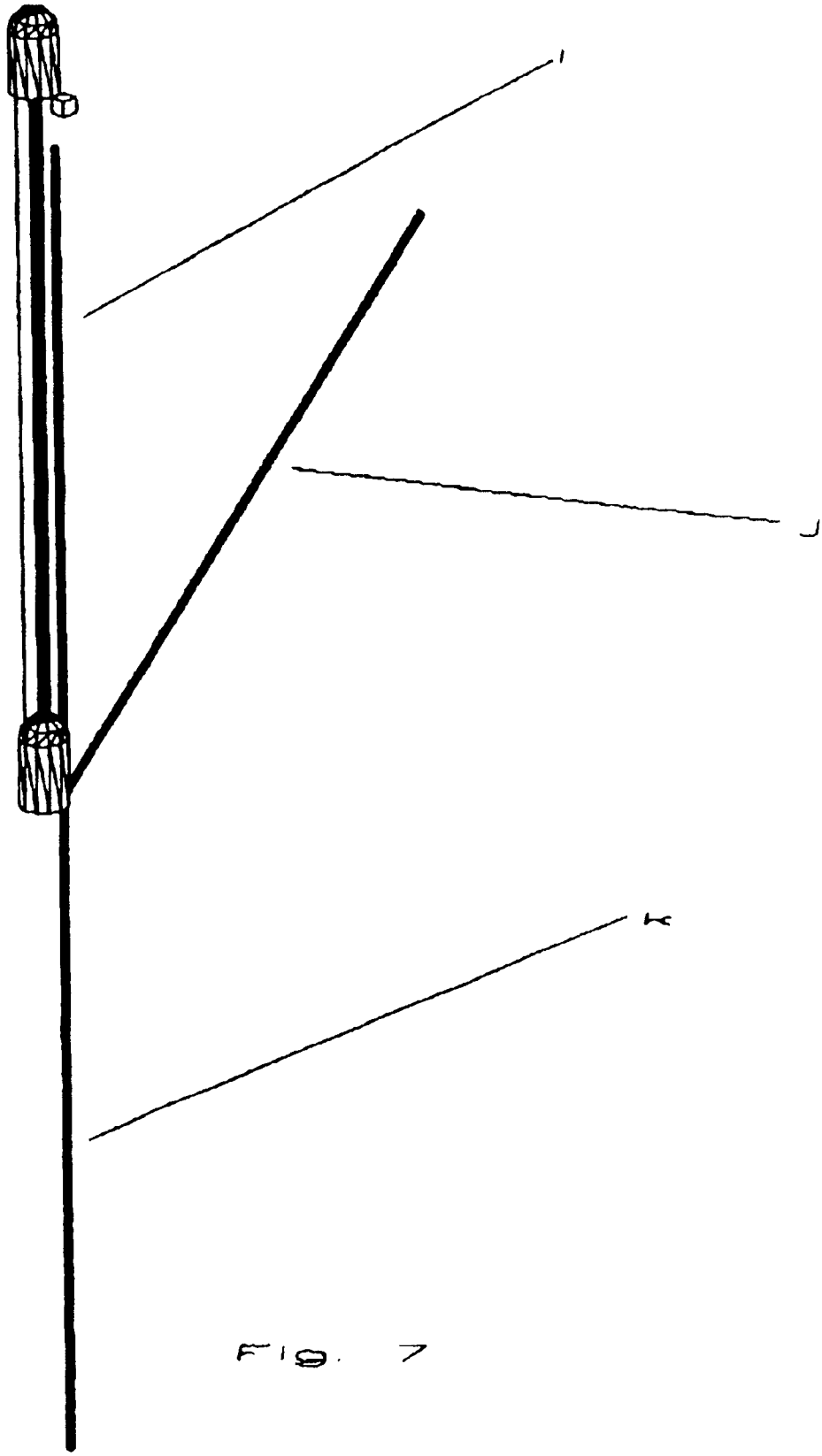
FIG. 7 is a schematic illustration of an embodiment of a rescue pylon version with a swinging "jackknife" ballast keel.

FIG. 7 illustrates another embodiment of the present invention in which the movable ballast carried on the pylon is configured as a swinging "jackknife" keel that can be moved between a position I folded alongside the pylon, a position J extending transversely away from the pylon or a position K extending away from the pylon in a direction away from the passenger compartment. FIG. 7 folded, (i) extending, (j) extended(k).

The present invention can also be configured to serve as a stable buoy for helicopter to ship refueling, as a search buoy, as an oceanography instrumentation buoy or as a stable, self erecting passenger vessel with movable stabilizing ballast.

What is claimed is:

1. A floating apparatus for transferring objects in a body of water from one surface vessel to another, the apparatus comprising:

a slender elongated pylon;

a cargo support at a first end of the pylon;

a variable buoyancy chamber on the pylon between the first end of the pylon and a second end of the pylon;

ballast carried by the pylon at the second end thereof, the ballast being of sufficient mass and being spaced from the variable buoyancy chamber by a sufficient distance to create a righting moment about the buoyancy chamber and establish an upright orientation of the pylon in the body of water with the cargo support disposed above the surface of the water and the ballast disposed below the surface of the water; and means for varying the buoyancy of the buoyancy chamber so as to maintain a desired submersion depth of the buoyancy chamber in the body of water.

2. The floating apparatus as recited in claim 1, wherein the buoyancy of the buoyancy chamber is varied by taking water into and expelling water from the buoyancy chamber.

3. The floating apparatus as recited in claim 2, and further including a source of pressurized air for introduction into the buoyancy chamber to expel water therefrom.

4. The floating apparatus as recited in claim 1, wherein the volume of the buoyancy chamber is variable, and the buoyancy of the buoyancy chamber is varied by expanding and reducing the volume of the buoyancy chamber.

5. The floating apparatus as recited in claim 4, and further including a source of pressurized air for expanding he me of the buoyancy chamber.

6. The floating apparatus as recited in claim 5, wherein the source of pressurized air is a motor-driven compressor carried on the pylon.

7. The floating apparatus as recited claim 1, wherein the ballast and the buoyancy chamber are shaped as paravanes to facilitate towing in the body of water.

8. An apparatus for rescuing persons from a body of water, the apparatus comprising:

an elongated pylon;

a compartment at a first end of the pylon for accommodating persons rescued from the body of water;

a variable buoyancy flotation device at a second end of the pylon;

ballast carried by the pylon and movable from a first position between the ends of the pylon to a second position extended beyond the second end of the pylon; and means for effecting movement of the ballast from the first position to the second position to thereby establish an upright orientation of the pylon in a body of water with the compartment disposed above the surface of the water and the ballast disposed below the surface of the water varying the buoyancy of the flotation device so as to maintain a desired submersion depth of the flotation device in the body of water.

9. A method for handling cargo in a body of water, the method comprising the steps of:

placing cargo at a first end of a slender elongated pylon deployed into the water, the pylon having a variable buoyancy chamber located between the first end and a second end of the pylon;

applying a righting moment to the pylon that orients the pylon upright in the water such that (1) the first end of the pylon is disposed above the surface of the water and (2) the buoyancy chamber and the second end of the pylon are disposed below the surface of the water; and varying the buoyancy of the buoyancy chamber so as to maintain a desired submersion depth of the buoyancy chamber in the water while maintaining the first end of the pylon disposed above the surface of the water.

10. The method as recited in claim 9, wherein, prior to placement on the pylon, the cargo is carried on a surface vessel, and further comprising the steps of:

fastening a line carried on the surface vessel to the first end of the pylon while the pylon is upright in the water;

drawing the line into the surface vessel while maintaining a region of the pylon near the surface of the water away from the surface vessel, to tilt the pylon toward the surface vessel;

transferring the cargo from the surface vessel onto the first end of the pylon while the pylon is tilted toward the surface vessel; and paying the line out from the surface vessel to thereby allow the pylon with cargo supported at the first end thereof to return to an upright orientation in the water.

11. The method as recited in claim 9, and further comprising the steps of:

fastening a line carried on a surface vessel to the first end of the pylon while the pylon is upright in the body of water;

drawing the line into the surface vessel while maintaining a region of the pylon near the surface of the water away from the surface vessel, to tilt the pylon toward the surface vessel;

transferring the cargo from the pylon to the surface vessel while the pylon is tilted toward the surface vessel; and paying the line out from the surface vessel to thereby allow the pylon to return to an upright orientation in the body of water.

12. The method as recited in claim 9, wherein the pylon carries a movable ballast, and further comprising the step of positioning the ballast away from the buoyancy chamber in a direction away from the first end of the pylon to apply the righting moment to the pylon.

13. The method as recited in claim 12, wherein, prior to placement on the pylon, the cargo is disposed below the surface of the water, and further comprising the steps of:

positioning the ballast at the first end of the pylon to thereby locate the first end of the pylon below the buoyancy chamber;

placing cargo onto the first end of the pylon while the first end of the pylon is located below the buoyancy chamber;

altering the orientation of the pylon so that the first end of the pylon is located near the surface of the water;

shifting the ballast to the second end of the pylon to thereby create a turning moment about the buoyancy chamber that lifts the first end of the pylon out of the water and orients the pylon upright with the first end and the cargo positioned above the surface of the water.

* * * * *